US005193665A

United States Patent [19]

Jankow

[11] Patent Number: 5,193,665

[45] Date of Patent: Mar. 16, 1993

[54] ELECTRIC PLUG WITH DISABLING MEANS

[76] Inventor: Robert A. Jankow, 31505 Carion, Warren, Mich. 48092

[21] Appl. No.: 759,663

[22] Filed: Sep. 13, 1991

[51] Int. Cl.[5] ..... H01H 27/06

[52] U.S. Cl. ..... 200/43.8; 200/51.09; 200/51.11; 200/572; 439/304

[58] Field of Search ..... 200/43.01, 43.02, 43.08, 200/43.04, 51 R, 51.09, 15.17, 51.11, 51.12, 51 LM, 572, 573, 574, 548, 550, 551, 252, 253.1, 257, 260; 70/57, DIG. 30; 439/133, 188, 304, 911

[56] References Cited

U.S. PATENT DOCUMENTS

| | | | |
|---|---|---|---|
| 2,153,721 | 4/1939 | Lottridge | 200/51 R |
| 2,217,585 | 10/1940 | Yates | 200/51 |
| 2,759,159 | 8/1956 | Teetor | 339/37 |
| 2,761,028 | 8/1956 | Teetor | 200/51 |
| 2,777,023 | 1/1957 | Sepulveda | 200/51.17 X |
| 2,846,530 | 8/1958 | Wintriss | 200/43.02 |
| 2,905,779 | 9/1959 | Schmier | 200/51.17 |
| 3,092,695 | 6/1963 | Abrams | 200/51.17 |
| 3,453,402 | 7/1969 | Suber | 200/43.02 |
| 3,691,327 | 9/1972 | Chesler | 200/43.02 |
| 4,008,382 | 2/1977 | De Rosa | 200/43.02 X |
| 4,167,658 | 9/1979 | Sherman | 200/51 |
| 4,647,735 | 3/1987 | Sicher | 200/43.08 |
| 4,969,833 | 11/1990 | Lindow | 439/133 |
| 5,070,219 | 12/1991 | Grosskrueger et al. | 200/43.01 X |

FOREIGN PATENT DOCUMENTS

| | | | |
|---|---|---|---|
| 54983 | 7/1938 | Denmark | 200/51 |
| 1182720 | 12/1964 | Fed. Rep. of Germany | 200/51 R |
| 2402291 | 4/1979 | France | 200/43.08 |
| 683196 | 11/1952 | United Kingdom | 200/51 R |

*Primary Examiner*—Henry J. Recla
*Assistant Examiner*—Glenn T. Barrett
*Attorney, Agent, or Firm*—Krass & Young

[57] ABSTRACT

An electric plug including a disabling mechanism to preclude unauthorized use of the plug. The disabling mechanism includes a key cylinder lock assembly including a cam member rotated in response to rotation of the key cylinder, a pair of conductive track strips extending from a cord inlet to a location proximate the prongs of the plug, an insulative block mounted for linear sliding movement within the hollow of the housing of the plug between open and closed positions, and a pair of conductive contact strips carried by the insulative block and each including a portion slidably engaging a respective track strip and a portion movable into electric contact with a contact portion of a respective prong in response to movement of the insulative block to a closed position in response to rotation of the key cylinder lock.

9 Claims, 3 Drawing Sheets

FIG-1
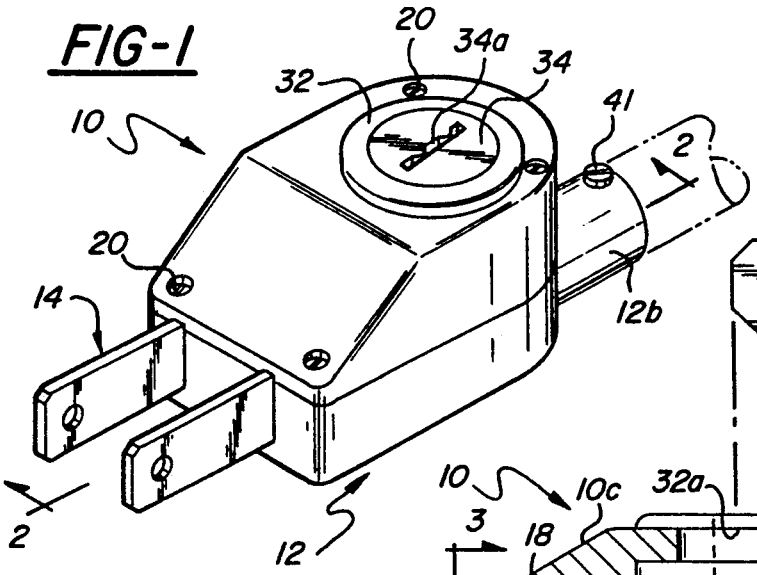
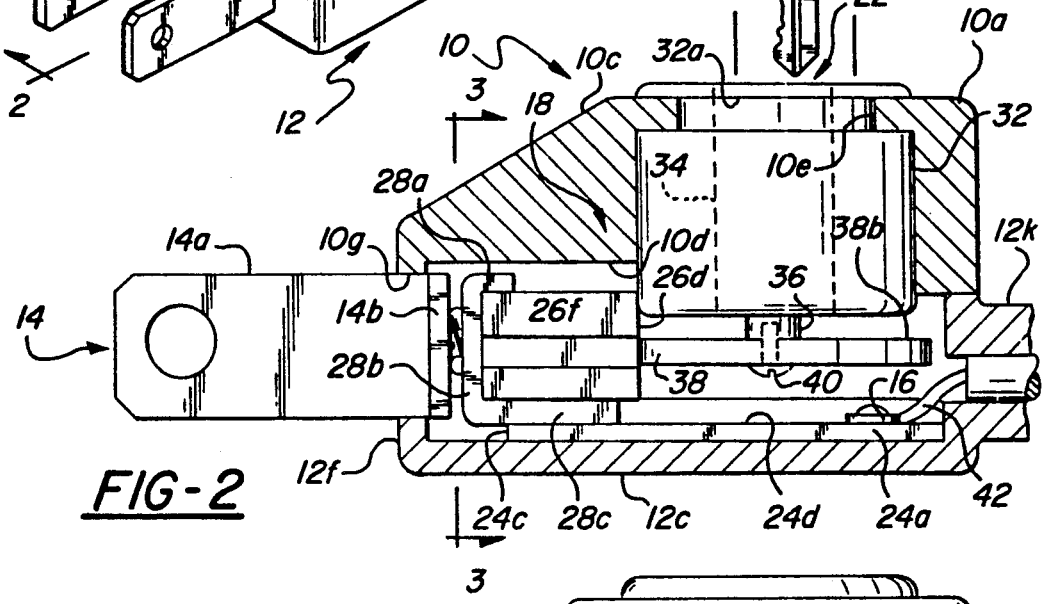
FIG-2
FIG-3
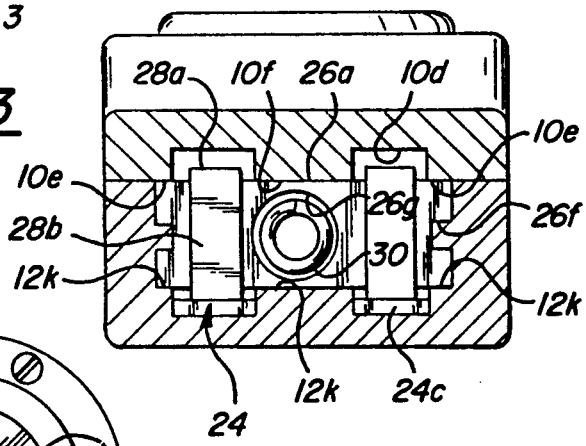
FIG-4
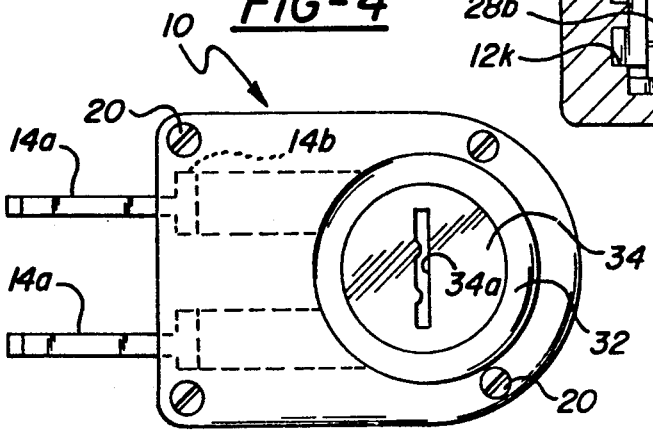

ELECTRIC PLUG WITH DISABLING MEANS

BACKGROUND OF THE INVENTION

This invention relates to an electric plug and more particularly to an electric plug having means for selectably disabling the plug when desired in order to prevent its unauthorized or undesired use.

In the case of many types of electrically operated devices and appliances, such as radio and television sets, record players, power tools and the like, it would be extremely desirable to have an inexpensive and convenient means for preventing unauthorized use of the device, for example, by children. Many disabling devices have been proposed for use in association with electric plugs to prevent unauthorized use of the plug, especially by children. However, none of these prior art disabling devices have enjoyed any significant degree of commercial success since they have been ineffective in preventing use of the plug and/or have involved a construction that is complex, expensive, or subject to malfunction.

SUMMARY OF THE INVENTION

This invention is directed to the provision of an electrical plug having a disabling means that is simple in construction, inexpensive, and effective in its disabling action.

The invention is directed to an electrical plug of the type including prongs for insertion into an electrical outlet, terminal means for connection to an electrical cord, and switch means, including a key cylinder lock assembly, operative upon rotation of the key cylinder of the key cylinder lock assembly to make and break electrical connection between the prongs and the terminal means.

According to an important feature of the invention, the switch means includes a switch member mounted for sliding linear movement in response to rotation of the key cylinder between a closed position in which an electrical circuit is established between the prongs and the terminal means and an open position in which the circuit is broken. This arrangement provides a simple, inexpensive, and effective arrangement for establishing and disrupting electrical connection within the plug.

According to a further feature of the invention, the switch means further includes conductive track members electrically connected to one of the prongs or the terminal means and contact strips carried by the switch member and slidingly engaging the track members. This arrangement provides a simple, inexpensive, and reliable means of making and breaking a circuit within the plug.

According to a further feature of the invention, the track members are connected to the terminal means and the contact strips each include a portion slidably engaging the respective track member and a portion adapted to electrically engage a respective prong in the closed position of the switch member. This specific arrangement further facilitates the effective operation of the switching function within the plug and further facilitates the simple and inexpensive manufacture of the plug.

According to a further feature of the invention, the plug includes a hollow housing of insulative material, the switch member comprises a block of insulative material mounted for sliding movement in the hollow of the housing, and the key cylinder lock assembly includes a cam mounted within the hollow of the housing and operative to slidably move the block between its open and closed positions in response to rotation of the key cylinder. This specific constructional interrelationship between the key cylinder lock assembly and the switch member allows the key cylinder lock to readily and positively move the switch member between its open and closed positions.

According to a further feature of the invention, the cam engages one face of the block and a spring engages an opposite face of the block so that the cam moves the block against the bias of the spring. This specific arrangement allows the movement of the switch member to be precisely and positively controlled it at all times so as to provide a precise and positive movement of the switch member between its open and closed positions.

BRIEF DESCRIPTION OF THE DRAWINGS

FIG. 1 is a perspective view of an electrical plug according to the invention;

FIG. 2 is a cross-sectional view taken on line 2—2 of FIG. 1;

FIG. 3 is a cross-sectional view taken on line 3—3 of FIG. 2;

FIG. 4 is a top view of the invention plug;

DETAILED DESCRIPTION OF THE PREFERRED EMBODIMENTS

Figure 5:
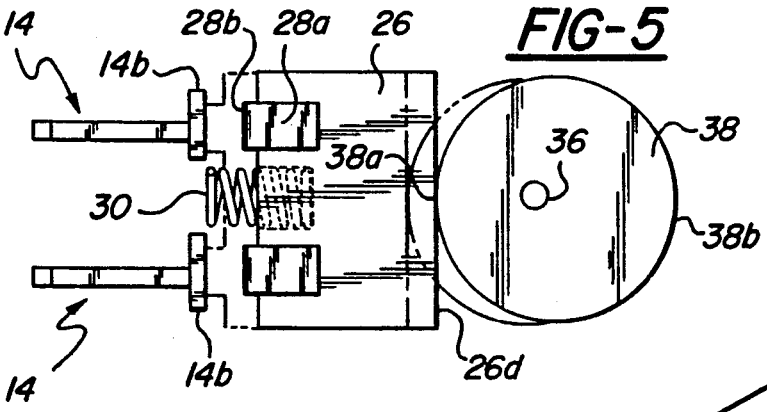
FIG. 5 is a diagrammatic view showing the switching action within the invention plug.
Figure 6:
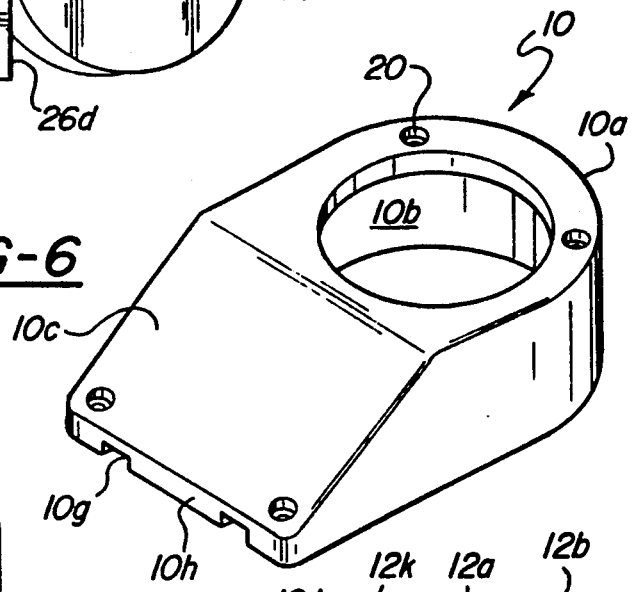
FIG. 6 is a perspective view of a top housing member utilized in the invention plug.
Figure 7:
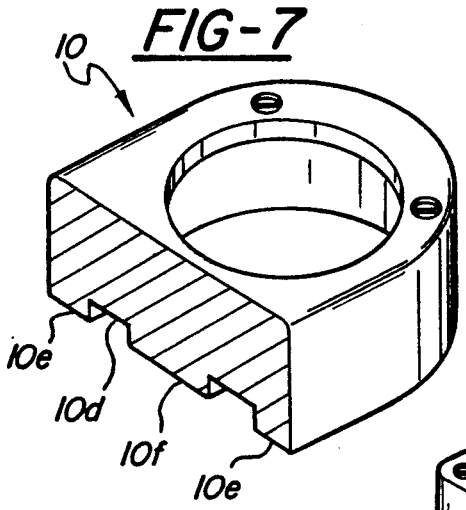
FIG. 7 is a cross-sectional perspective view taken on line 7—7 of FIG. 6.
Figure 8:
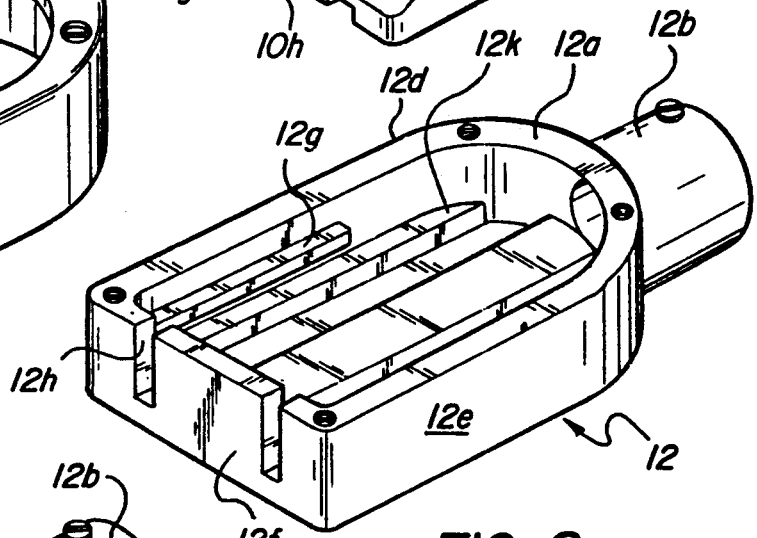
FIG. 8 is a perspective view of a bottom housing member of the invention plug.
Figure 9:
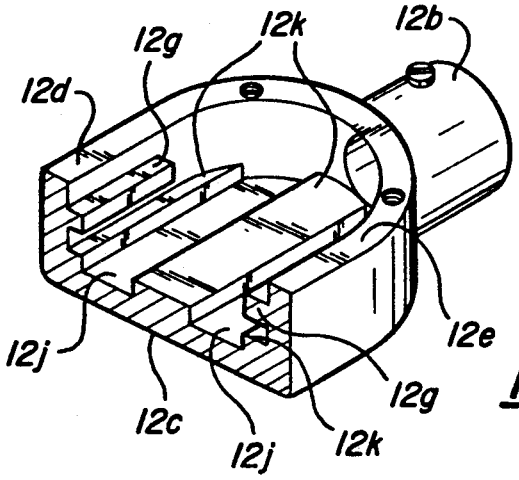
FIG. 9 is a perspective cross-sectional view taken on line 9—9 of FIG. 8.
Figure 10:
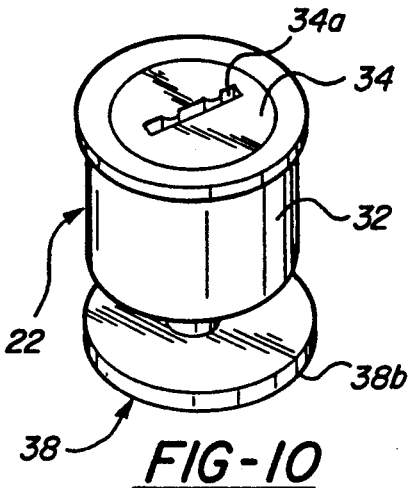
FIG. 10 is a perspective view of a key cylinder lock assembly utilized in the invention plug.
Figure 11:
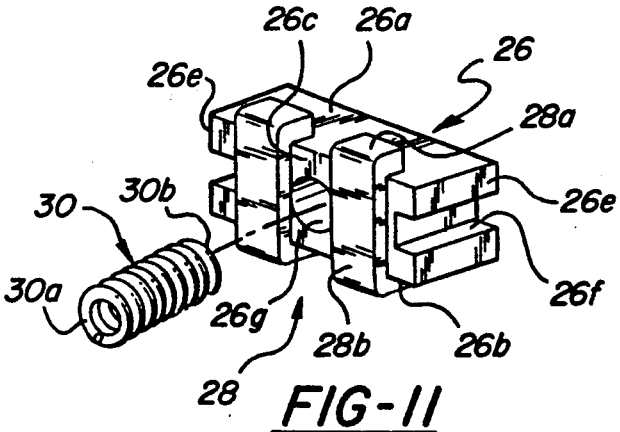
FIG. 11 is a perspective view of a switch member assembly utilized in the invention plug.
Figure 12:
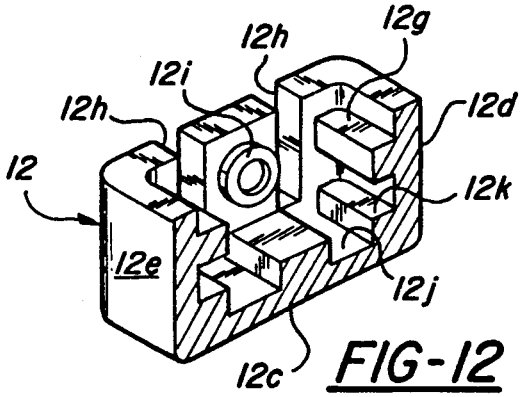
FIG. 12 is a perspective cross-sectional view taken on line 12—12 of FIG. 8.
Figure 13:
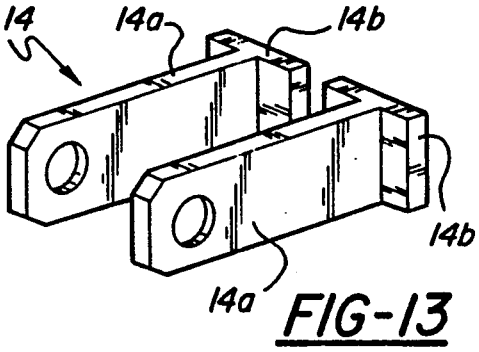
FIG. 13 is a perspective view of prongs utilized in the invention plug.

The invention electrical plug, broadly considered, includes an upper housing 10, a lower housing 12, a pair of prongs 14, a pair of terminal means 16, and switch means 18.

Housings 10 and 12 are formed of a suitable insulative material such, for example, as a suitable plastic material.

Upper housing 10 includes a rear portion **10*a* defining a bore 10*b*; a tapered forward portion 10*c*; parallel grooves 10*d* in the lower face of the housing forward portion 10*c* opening rearwardly in the lower end of bore 10*b*; guide surfaces 10*e* defined on the lower face of the housing outboard of grooves 10*d*; a central guide surface 10*f* defined on the lower face of the housing between grooves 10*d*; and slits 10*g* in the lower edge of the forward end wall 10*h* of the housing in respective longitudinal alignment with grooves 10*d***.

Lower housing 12 is hollow and includes a rearward wall 12*a* defining a tubular cord inlet 12*b*; a bottom wall 12*c*; spaced side walls 12*d* and 12*e*; and a forward wall 12*f*. Guide ribs 12*g* are formed on the inner surfaces of side walls 12*d* and 12*e*; upwardly opening slits 12*h* are provided in front wall 12*f*; a circular socket 12*i* is provided on the inner face of end wall 12*f* between the slits 12*h*; and a pair of parallel grooves 12*j* extend longitudinally in bottom wall 12*c* with longitudinal guide surfaces 12*k* defined between and outboard of grooves 12*j*.

Upper and lower housings 10 and 12 may be joined together in any suitable manner such, for example, as by cementing or fusing the members together at their interface or, as shown, by the use of screws 20 passing downwardly through holes in the upper housing for threaded engagement with threaded bores in the lower housing.

Prongs 14 are formed of a conductive material such as brass and each includes a main body portion 14*a* for insertion in known manner into an electrical outlet and a contact portion 14*b* extending at right angles with respect to the main body portion 14*a*.

Terminal means 16 may take any of various known forms and may, as shown, comprise a pair of screws including head portion 16*a* and threaded shank portion 16*b*.

Switch means 18 includes a key cylinder lock assembly 22, a pair of track strips 24, a switch block 26, a pair of contact strips 28, and a coil spring 30.

Key cylinder lock assembly 22 may, for example, be of the type available from the National Lock Company of Mauldin, S.C. as part No. C8051-14A and includes a key cylinder housing 32, a key cylinder 34 mounted for rotation within housing 32 and defining a key opening 34*a*, a shaft 36 secured to the lower end of key cylinder 34, and a cam 38 secured to the lower end of shaft 36 by a screw 40.

Track strips 24 are formed of a suitable conductive material such as brass and are sized to fit snugly within grooves 12*j* in the bottom wall of the lower housing member. Each track strip includes a main body portion 24*a* and an opening 24*b* at the rear end of the track sized to pass a terminal screw 16. Track strips 24 are preferably molded into the grooves 12*j* during the molding operation to form the lower housing 12 with the forward ends 24*c* of the track strips spaced rearwardly from the inner face of the front housing wall 12*f*. Track strips 24 have a thickness less than the depth of the grooves 12*j* so that the upper face 24*d* of each track strip is spaced downwardly from the guide surfaces 12*k* defined adjacent the track strips.

Switch member 26 comprises a block formed of an insulative material such as a suitable plastic and includes a top face 26*a*, a bottom face 26*b*, a front face 26*c*, a rear face 26*d*, and sides faces 26*e*. A groove 26*f* is formed in each side face 26*e* sized to slidably receive a respective guide rib 12*g* on lower housing 12, and a socket 26*g* is formed in front face 26*c* sized to receive the rear end of coil spring 30.

Contact strips 28 are formed of a suitable conductive material such as brass and are wrapped around block 26 in a U-configuration with suitable crimping employed to preclude separation of the strips from the block. Each contact strip 28 includes an upper portion 28*a* positioned against the upper face 26*a* of the block; a front portion 28*b* positioned against the front face 26*c* of the block, and a lower portion 28*c* positioned against the lower face 26*b* of the block and extending essentially the full length of the block.

Coil spring 30 is of known form and includes a front end 30*a* sized to seat within socket 12*i* on lower housing 12 and a rear end 30*b* sized to seat in socket 26*g* in block member 26.

In the assembled relation of the various parts of the invention electrical plug, key cylinder housing 32 is fitted snugly within bore 10*b* of upper housing 10 with a lip portion 10*e* of the upper housing snap fit into a groove 32*a* in the key cylinder housing and with the lower end of the key cylinder housing projecting into the hollow of the lower housing 12 to position the cam 38 within the hollow of the lower housing; prongs 14 are positioned in slits 12*h* and 10*g* with the contact portions 14*b* of the prongs positioned against the inner face of lower housing front end wall 12*f*; track strips 24 are positioned in grooves 12*i*; terminal screws 16 pass through holes 24*b* in the track strips for threaded engagement with the bottom wall 12*c* of the lower housing; insulative block 26 is mounted for sliding linear movement within the hollow of the lower housing with housing ribs 12*g* slidably guiding in block groove 26*f*, block upper face 26*a* slidably guiding on upper housing guide surfaces 10*e* and 10*f*, and block lower face 26*b* slidably guiding on lower housing guide surfaces 12*k*; and spring 30 is seated at its forward end 30*a* in socket 12*a* in lower housing 12 and at its rearward end 30*b* in socket 26*g* in the front face 26*c* of block 26 to urge the block rearwardly to its open position in which contact strip portions 28*b* are spaced rearwardly from prong contact portions 14*b*. In this rearward or open position of the block 26, the block seats against the housing 32 of the key cylinder assembly and against the circular portion 38*a* of the cam 38 to delimit and define the rearward or open position of the switch means.

In use, a cord 40 from an appliance, power tool, or the like is passed through outlet 12*b* and secured by set screw 41 and the individual leads or wires 42 of the cord are respectively connected beneath the respective terminal screws 16 so as to establish electrical contact between the wires and the respective track strips 24. In the absence of a key to actuate the key cylinder lock assembly, spring 30 acts to maintain the switch assembly in its open position and, specifically, acts to maintain block 26 in its open or rearward position in which the rear face 26*e* of the block is pressed against the key cylinder housing 32 and in which the portions 28*b* of the contact strips 28 are spaced rearwardly from the contact portions 14*b* of the prongs so as to preclude electrical connection between the terminal 16, and thereby the wires 42, and the prongs 14 and thereby prevent the transmission of electrical power from the outlet to the appliance, power tool, or the like.

When someone authorized to use the appliance, tool, or the like desires to provide power to the appliance or tool, a key 44 is inserted into the key opening 34*a* so as to align the tumblers of the key cylinder lock assembly in known manner and allow the key cylinder 34 to be rotated. As the key cylinder is rotated, the cam 38 is also rotated so as to move the cam through 180 degrees and move the eccentric portion 38*b* of the cam into coaction with the rear face 26*e* of the block 26 and move the block forwardly to a position in which the contact strip portions 28*b* contact the prong contact portions 14*b* to establish electrical connection between the terminal means 16 and the prongs 14 and thereby allow the delivery of power from the electrical outlet to the appliance or tool.

The switch is maintained in its closed position against the bias of the spring 30 by the typical detent mechanism included within the key cylinder lock assembly so that the switch will not return to its open position to disrupt power delivery to the appliance or tool unless and until the key 44 is again deliberately employed to rotate the key cylinder through 180 degrees and move the eccentric portion 38*b* of the cam out of engagement with the rear face of the block 26 and allow the block to return to its open position under the urging of the spring 30 as circular portion 38*a* of the cam is brought into engagement with the rear face of the block.

Figure 15:
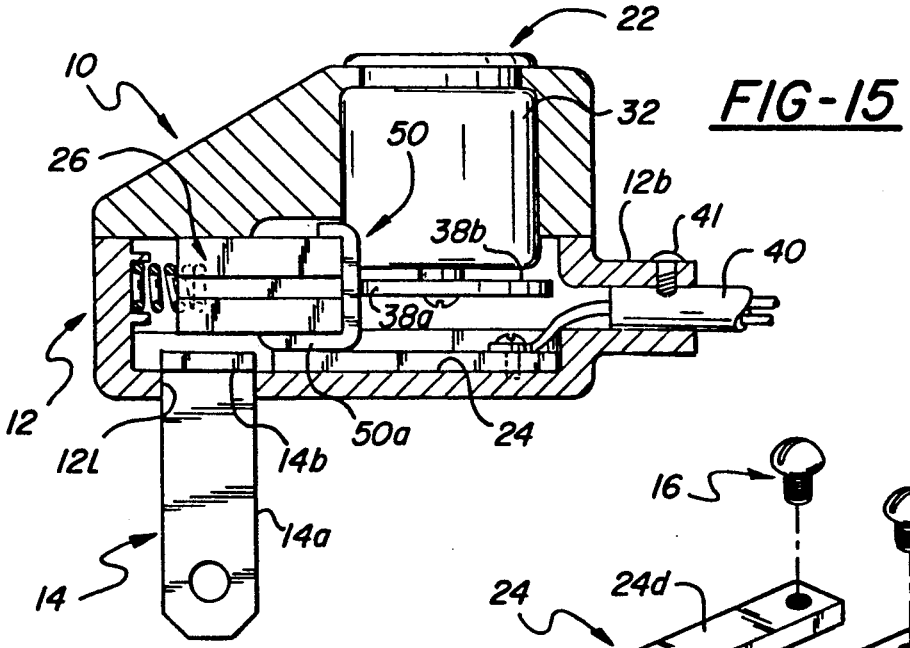
FIG. 15 is a cross-sectional view of an alternate form of the invention plug.
Figure 14:
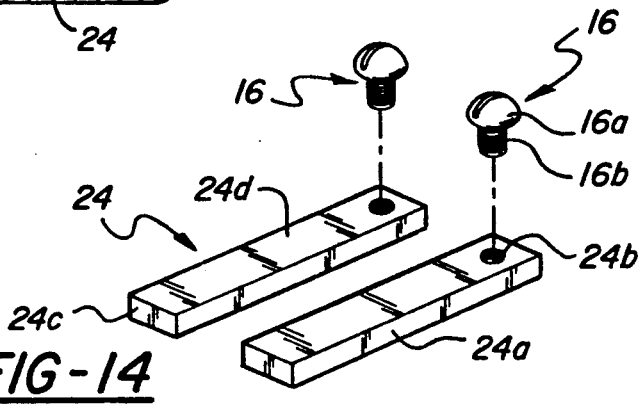
FIG. 14 is a perspective view of conductive track strips utilized in the invention plug.

The alternate embodiment of the invention seen in FIG. 15 is generally similar to the embodiment seen in FIGS. 1–14 with the exception that the prongs 14 pass through slits 121 in the lower wall 12*c* of housing 12 so as to extend in a direction perpendicular to the direction of sliding movement of the block 26 and the contact strips 50 are positioned on the rear face 26*d* of the block 26 with a lower portion 50*a* of each strip slidably engaging a respective track strip 24 and movable into electrical contact with the contact portion 14*b* of the respective prong in response to forward movement of the block 26 under the urging of the eccentric portion 38*b* of the cam 38 in response to rotation of the key cylinder of the key cylinder lock assembly.

The invention, in either embodiment, will be seen to provide an electrical plug with a disabling means to preclude unauthorized use that is simple in construction, inexpensive to manufacture, positive in operation, and extremely durable and reliable.

Whereas preferred embodiments of the invention have been illustrated and described in detail, it will be apparent that various changes may be made in the disclosed embodiments without departing from the scope or spirit of the invention.

I claim:

1. An electrical plug including prongs for insertion into an electrical outlet, terminal means for connection to an electrical cord and switch means, including a key cylinder lock assembly, operable upon rotation of the key cylinder lock assembly to make and break electrical connection between the prongs and the terminal means, characterized in that the switch means includes a switch member mounted for sliding linear movement in response to rotation of the key cylinder between a closed position in which an electrical circuit is established between the prongs and the terminal means and an open position in which the circuit is broken; the switch means further includes conductive track members selectively connected to said terminal means and contact strips carried by said switch member which slidably engage said track members; said track members are connected to said terminal means; said contact strips each include a portion slidably engaging a respective track member and a portion adapted to electrically engage a respective prong in the closed position of the switch member; said plug includes a hollow housing of insulative material; said switch member comprises a block of insulative material mounted for sliding movement in the hollow of the housing; and said key cylinder lock assembly includes a cam mounted within the hollow of the housing and operative to slidably move the block between its open and closed positions in response to rotation of the key cylinder.

2. An electrical plug according to claim 1 wherein sid switch means further includes a spring engaging the block and operative to bias the block toward its open position.

3. An electrical plug according to claim 2 wherein the block has a first face and a second face opposite said first face and wherein said cam engages said first face of the block and said spring engages said second face of the block so that the cam moves the block against the bias of the spring.

4. An electrical plug including a hollow housing of insulative material, a pair of prongs extending from the housing for insertion into an electrical outlet, a pair of terminal means for connection to an electrical cord, and switch means operative to make and break electrical connection between the prongs and the terminal means, characterized in that the switch means includes a pair of conductive track strips each connected at one end to a respective terminal means and extending within the hollow of the housing to a location proximate a respective prong, an insulative block mounted for linear sliding movement within the hollow of the housing between an open and a closed position, user actuable means for moving the block between its open and closed positions, and a pair of conductive contact strips carried by the insulative block and each including a portion slidably engaging a respective track strip and a portion adapted to electrically engage a respective prong in the closed position of the block.

5. An electrical plug according to claim 4 wherein the prongs extend from the housing in a direction generally parallel to the direction of sliding movement of the block.

6. An electrical plug according to claim 4 wherein the prongs extend from the housing in a direction generally perpendicular to the direction of sliding movement of the block.

7. An electrical plug according to claim 4 wherein the block has a first face and the user actuable means includes a cam acting against said first face of the block and a rotary member rotatable by the user to rotate the cam and move the block between its open and closed positions.

8. An electrical plug according to claim 7 wherein the rotary member comprises the key cylinder of a key cylinder lock assembly.

9. An electrical plug according to claim 7 wherein the block has a second face opposite said first face and wherein the plug further includes a spring positioned in the hollow of the housing and engaging said first face of the block so that the spring resists movement of the block by the cam to its closed position.

* * * * *